United States Patent [19]

Mirabel et al.

[11] Patent Number: 4,878,268

[45] Date of Patent: Nov. 7, 1989

[54] DEVICE FOR DRAWING ROVES OR SLIVERS OF FIBERS ON A SPINNING MACHINE

[75] Inventors: Pierre Mirabel; Marcel Schoumacher, both of Roanne, France

[73] Assignee: Devtex, France

[21] Appl. No.: 222,538

[22] Filed: Jul. 21, 1988

[30] Foreign Application Priority Data

Aug. 28, 1987 [FR] France ..... 87 12176

[51] Int. Cl.[4] ..... D01H 5/74; D01H 5/56

[52] U.S. Cl. ..... 19/258; 19/267; 19/295; 57/315

[58] Field of Search ..... 19/258, 266, 267, 271, 19/294, 295; 57/315

[56] References Cited

U.S. PATENT DOCUMENTS 2,398,756 4/1946 Tarr ..... 19/258
2,686,940 8/1954 Burnham ..... 19/258

FOREIGN PATENT DOCUMENTS 1343069 10/1963 France .
2081694 1/1975 France .
2081886 1/1975 France .

*Primary Examiner*—Werner H. Schroeder
*Assistant Examiner*—Sara M. Current
*Attorney, Agent, or Firm*—Arnold, White & Durkee

[57] ABSTRACT

This invention relates to a device for drawing roves or slivers of fibers on a spinning machine with a view to converting this material into spun yarns, of the type incorporating pendulous arms, constituted essentially by an assembly comprising, mounted on the support frame of the machine, a series of splined shafts extending over the whole length of the machine and common to all the work positions, said shafts being driven in rotation and, on the other hand, presser elements constituted by rollers mounted on a pivoting support arm comprising means ensuring pressure of the presser rollers against the splined shafts, wherein the pendulous arm bearing the presser elements is assembled on the frame of the machine via a support comprising means for simultaneously separating the presser rollers parallel to the line of splined shafts.

5 Claims, 3 Drawing Sheets

Fig. 3
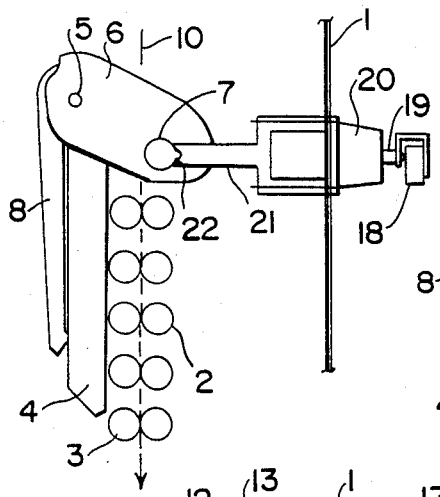
Fig. 5
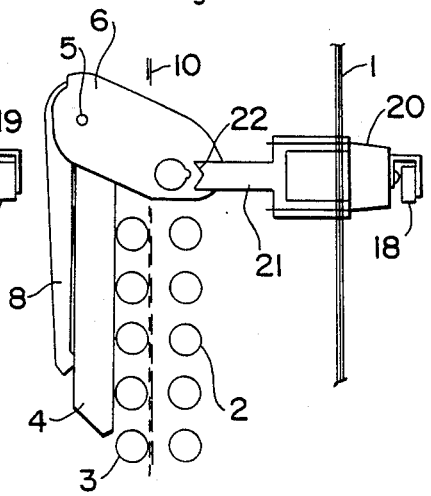
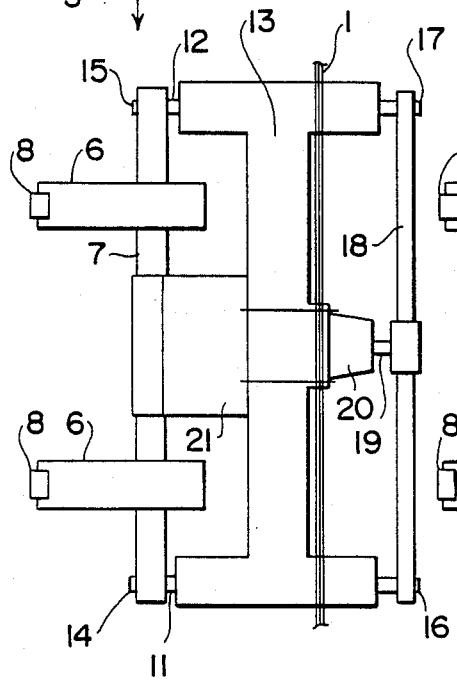
Fig. 4
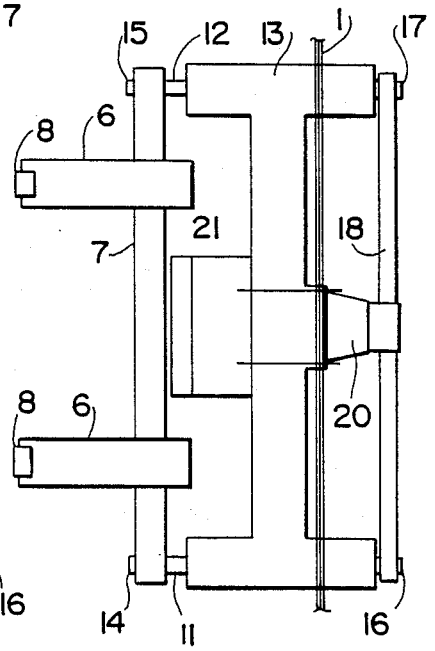
Fig. 6

DEVICE FOR DRAWING ROVES OR SLIVERS OF FIBERS ON A SPINNING MACHINE

FIELD OF THE INVENTION

The present invention relates to a device for drawing roves or slivers of fibers on a spinning machine.

BACKGROUND OF THE INVENTION

This invention concerns an improvement to the devices for drawing fibers (in the form of roves or slivers) employed on spinning machines when making spun yarns of any type whatsoever (stub spun yarn, core spun yarn, self-twisted spun yarn, . . . ). It deals more particularly with an improvement made to the drawing devices incorporating so-called "pendulous arms", such as for example those marketed by the firm SKF, well known to the man skilled in the art and described in particular in French Patents published under Nos. 1 343 069, 2 081 694 and 2 081 886.

Such pendulous arms which are shown schematically in accompanying FIGS. 1 and 2, in side view in work position in FIG. 1 and in disconnected view in FIG. 2, are essentially constituted by an assembly comprising, mounted on the support frame 1 of the machine, on the one hand, a series of splined shafts 2 extending over the whole length of the machine and common to all the work positions, said shafts being driven in rotation, their number and spaced apart relationship being a function of the materials to be treated and the drawing rates to be given and, on the other hand, presser elements constituted by rollers 3, mounted on a supporting, so-called "pendulous" arm 4. As seen in particular in the French Patents mentioned hereinabove, the pressure exerted by the rollers 3 on the splined shafts 2 is generally obtained by means of helical springs working in compression. The pressure is adjustable on each roller 3 individually. Other means such as pneumatic means may possibly be used to ensure this pressure. The arm 4 is mounted about a pivot 5 on a support 6 itself fixed on a bar 7 extending over the whole length of the loom. The abutment of the presser rollers against the splined shafts 2 is obtained by means of a lever 8 on which the operator acts in order either to place the assembly in work position (FIG. 1) or, on the contrary, to separate the presser rollers 3 when an operation must be effected on the drawing system. In general, disconnection is effected, after the pressure is released, in the order: feed zone (A) towards outlet zone (B) and, at closure, the order is reversed. The structure and operation of such drawing devices are clearly shown in French Pat. No. 2 081 886 and will therefore not be described in detail.

Accompanying FIGS. 1 and 2 clearly show that, when it is desired to open the drawing system, for example upon a restart, there is a very large clearance between the splined shafts and the presser rollers which, in certain cases, may be detrimental when it is desired to render such operations automatic.

In addition to this drawback, upon disconnection, windings of fibers may be formed around the splined shafts and, furthermore, upon restart, there is the problem of refining of the feed rove, which problem is all the greater as the present tendency is to make very high drawing rates and therefore to use feed roves of high count.

An improvement to such pendulous drawing systems has now been found, and this forms the subject matter of the present invention, which overcomes these drawbacks and which ensures in particular disconnection of the drawing system without acting on the pressure exerted on the presser rollers and without pivoting of the pendulous arm, whilst maintaining the rove in its state of drawing, this facilitating the operations of restart, particularly in the case of the feed material being constituted by a sliver of fibers of high count.

SUMMARY OF THE INVENTION

The invention therefore generally relates to a device for drawing roves or slivers of fibers on a spinning machine with a view to converting this material into spun yarns, said device being of the type incorporating pendulous arms, constituted essentially by an assembly comprising, mounted on the support frame of the machine, on the one hand a series of splined shafts extending over the whole length of the machine and common to all the work positions, said shafts being driven in rotation and, on the other hand, presser elements constituted by rollers mounted on a pivoting support arm and which comprises means ensuring pressure of the presser rollers against the splined shafts, and it is characterized in that the pendulous arm bearing the presser elements is assembled on the frame of the machine via a support comprising means for simultaneously separating the presser rollers parallel to the line of splined shafts. Such a design allows the arm to open with minimum space requirement, which facilitates implantation of various accessories on the machine, such as for example the installation of a service robot allowing automatization.

According to an embodiment of the invention, in which the spinning machine comprises, for each work position, a drawing device making it possible to treat two roves simultaneously, i.e. in which two pendulous arms are mounted in parallel on a support bar, said bar is mounted on the frame of the machine via a support common for these two drawing systems, said support serving as guiding and holding element for two sliding spindles of which one of the ends is connected to the support bar and of which the other end is subjected to the action of means for controlling said slide, these means being constituted for example by a pneumatic jack whose rod acts on a cross member connecting the ends of said spindles.

Furthermore, the drawing device according to the invention may possibly be associated with means ensuring automatic gripping of the fibrous material during displacement of the pendulous arm, and possibly means for moving the rove away from the surface of the splined rollers, for example by displacement of mobile guides disposed between each cylinder and/or action of an air jet acting against the rove.

BRIEF DESCRIPTION OF THE DRAWINGS

The invention will be more readily understood on reading the following description with reference to the accompanying drawings, in which:

FIGS. 3 and 4 are diagrams, viewed respectively from the side and from above, of a pendulous arm according to the invention in normal work position.

FIGS. 5 and 6 are views corresponding to FIGS. 3 and 4, showing a drawing device according to the invention in open position, for example to effect a restart operation.

Figure 2:
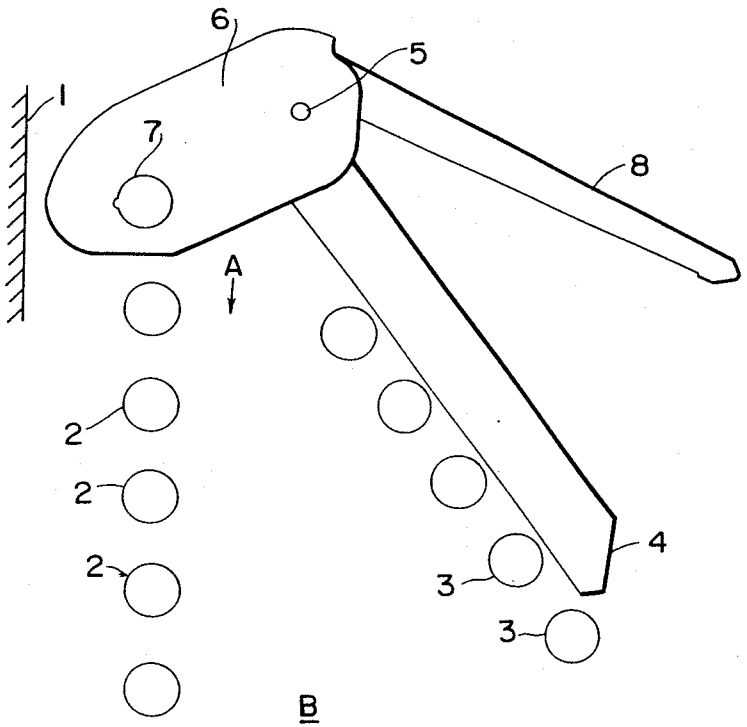
Fig. 2 PRIOR ART
FIGS. 1 and 2 schematically illustrate, as mentioned hereinabove, the structure and operation of a conventional pendulous arm.
Figure 1:
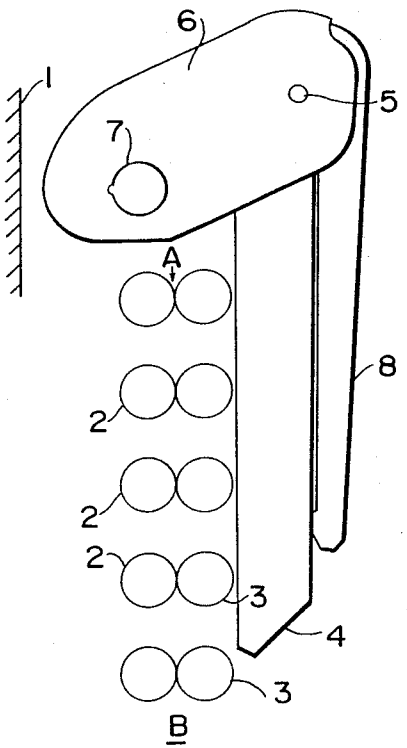
Fig. 1 PRIOR ART

In the following description, those elements of the device according to the invention similar to those of the conventional pendulous arms shall be designated by the same references as those used hereinabove for FIGS. 1 and 2.

Furthermore, in the following description, the invention will be described for a twin drawing system, i.e. one comprising two drawing devices mounted on a common support, but it is obvious that this is not limiting.

DETAILED DESCRIPTION OF THE DRAWINGS

Figure 8:
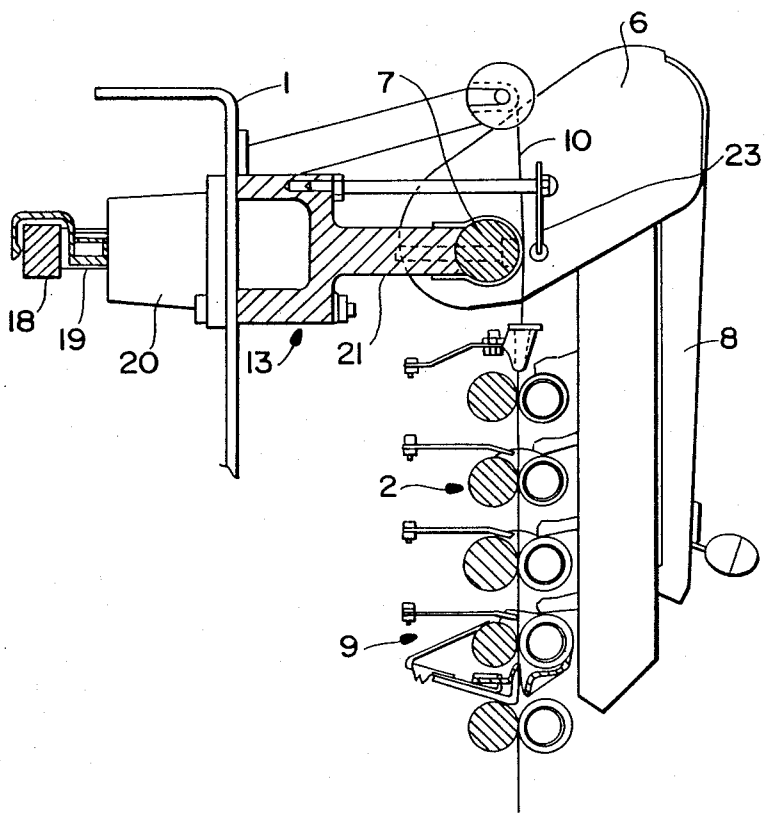
FIG. 8 is a section along axis A of FIG. 7.

Referring now to the accompanying drawings, the drawing device according to the invention comprises similarly to the conventional drawing systems with pendulous arm, mounted on the support frame 1 of the machine, a series of splined shafts 2 extending over the whole length of said machine and common to all the work positions. These splined shafts 2 are driven in rotation, their number and spaced apart relationship being a function of the materials to be treated and of the drawing rate. Furthermore, certain of these shafts may be associated with a sleeve system 9 as shown in FIG. 8.

Drawing of the rove 10 is ensured by means of presser rollers 3 mounted on a so-called "pendulous" support arm 4. The pressure exerted by the rollers is generally obtained by means of springs (not shown) working in compression and mounted inside the arm 4. The arm 4 is mounted about a pivot 5 on a support 6 itself fixed on a bar 7. In the present case, the bar 7 supports two similar drawing systems which are therefore mounted in parallel on the machine. According to the prior art, abutment of the presser roller 3 against the splined shafts 2 may be obtained by means of a lever 8 on which the operator may act.

Furthermore, according to the improvement brought by the invention, the pendulous arms are assembled on the frame of the machine so as to be able simultaneously to move all the presser rollers 3 away from the splined shafts 2 and this parallel thereto without acting on the lever 8. According to the embodiment illustrated, such simultaneous displacement of all the presser rollers 3 is obtained by mounting the support bar 7 on an assembly capable of being displaced at right angles to the plane of drawing and which, in the present case, is constituted by two rods 11, 12 mounted to slide inside a support 13 itself fast with the frame 1. The ends 14, 15 of the rods 11, 12 are fixed to the support bar 7, whilst ends 16, 17 are fixed to a cross member 18 which is connected to the rod 19 of a jack 20. In normal work position (cf. FIGS. 3 and 4), the jack 20 pushes the cross member 18 and consequently maintains the rollers 3 in abutment against the splined shafts 2. The stroke is preferably limited by providing a stop 21 on the support 13, stop whose end 22 comes into contact with the support bar 7.

When it is desired to stop the drawing system, for example to change a full package or a feed rove can, it suffices to control the jack 20 which allows drive of the connecting bar 18, therefore drive of the rods 11, 12 and consequently displacement of the support bar 7, therefore the presser rollers 3 (cf. FIGS. 5, 6).

Thanks to such a device, it is therefore possible to move the presser rolls 3 away from the splined shafts 2 parallel thereto, therefore having a minimum space requirement and maintaining the rove in its state of drawing.

Figure 7:
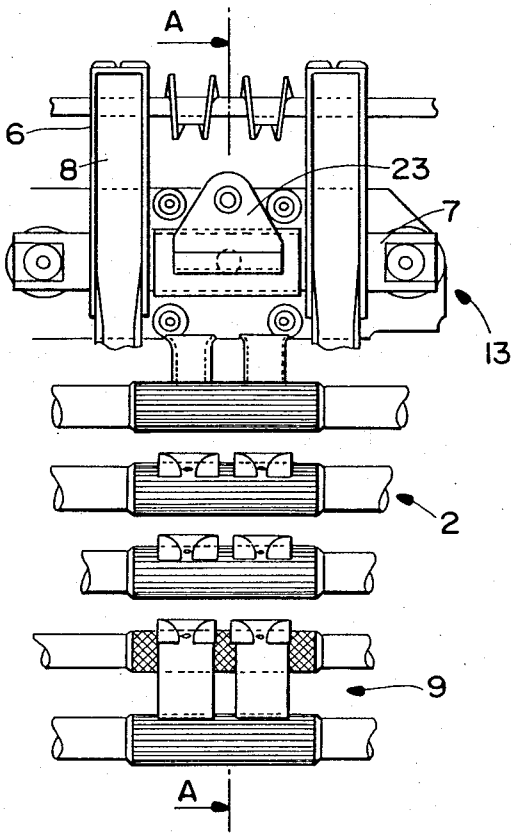
FIG. 7 is a partial front view of a spinning machine equipped with a drawing device according to the invention.

Moreover, as shown in detail in FIGS. 7 and 8, the drawing system according to the invention may be associated with a rove grip 23 disposed opposite the support bar 7, so that, when the latter is displaced during the moving apart movement of the presser rollers 3, it comes into abutment against the surface of said rove grip 23.

Moreover, if the elements for guiding the rove at the inlet of the drawing system and between each zone included between the splined shafts and the presser rollers can be fixed (cf. FIG. 8), it may be envisaged to connect these guiding elements to the support bar 7 (or any other element displaced during the moving away movement of the presser rollers), which makes it possible to move the rove away from the rollers and consequently eliminates any risk of winding of said rove.

Other additional elements, such as for example a blowing system, may be provided for effecting such separation.

Such a drawing device is particularly adapted for all spinning machines in which it is desired to effect a strong drawing from a feed sliver, being given that it is possible, thanks to the simultaneous moving away of all the presser rollers, to maintain the rove in its drawn state over the length of the drawing system. Furthermore, the very small space requirement during opening which results from the design of such a device facilitates implantation of various accessories on the machine and in particular makes it possible to solve numerous problems raised by the automatization of textile machines, particularly when it is desired to associate therewith a service robot.

The invention is, of course, not limited to the embodiment described hereinabove but it covers all the variants thereto made in the same spirit. It is furthermore obvious, although this has not been stated hereinabove, that it is always possible to use such a drawing device in conventional manner as illustrated in FIGS. 1 and 2.

What is claimed is:

1. In a device for drawing roves or slivers of fibers on a spinning machine with a view to converting this material into spun yarns, of the type incorporating pendulous arms, constituted essentially by an assembly comprising, mounted on the support frame of the machine, a series of splined shafts extending over the whole length of the machine and common to all the work positions, said shafts being driven in rotation and, on the other hand, presser elements constituted by rollers mounted on a pivoting support arm comprising means ensuring pressure of the presser rollers against the splined shafts, the pendulous arm bearing the presser elements is assembled on the frame of the machine via a support comprising means for simultaneously separating the presser rollers parallel to the line of splined shafts.

2. The drawing device of claim 1, comprising two pendulous arms mounted in parallel on a support bar, wherein said bar is mounted on the frame of the machine via a common support for these two drawing systems, said support serving as element for guiding and maintaining two sliding spindles of which one of the ends is connected to the support bar and of which the other end is subjected to the action of means for controlling said slide.

3. The drawing device of claim 2, wherein the means for controlling slide of the spindles are constituted by a pneumatic jack whose rod acts on a cross member connecting the ends of the spindles.

4. The drawing device of one of claims 1 wherein it is associated with means for ensuring automatic gripping of the fibrous material during displacement of the pendulous arm.

5. The drawing device of one of claims 1 wherein it comprises means for moving the rove away from the surface of the splined shafts during displacement of the presser rollers.

* * * * *